United States Patent [19]

Kwok-Fai

[11] 4,419,956

[45] Dec. 13, 1983

[54] INKING MACHINES

[76] Inventor: Jim Kwok-Fai, 20 Pennington St., 3rd Floor, Hong Kong, Hong Kong

[21] Appl. No.: 378,339

[22] Filed: May 14, 1982

Related U.S. Application Data

[63] Continuation-in-part of Ser. No. 246,691, Apr. 16, 1981, abandoned.

[51] Int. Cl.[3] ..... B05C 1/00

[52] U.S. Cl. ..... 118/235; 118/249; 118/258; 118/259; 427/141

[58] Field of Search ..... 118/235, 249, 258, 259; 427/141

[56] References Cited

U.S. PATENT DOCUMENTS

| | | | |
|---|---|---|---|
| 1,804,976 | 5/1931 | Fortier | 118/235 X |
| 2,366,907 | 1/1945 | Hurlbut | 118/235 X |
| 3,747,561 | 7/1973 | Helm | 118/258 X |
| 4,011,830 | 3/1977 | Anderson et al. | 118/235 X |
| 4,213,419 | 7/1980 | Nicholson | 118/235 X |

*Primary Examiner*—Bernard D. Pianalto

*Attorney, Agent, or Firm*—Warren B. Kice

[57] ABSTRACT

Most ribbon re-inking machines are not clean and convenient to use. The present machine is relatively clean to use because the ink reservoir is normally kept oriented so that leakage does not occur. Thus, the reservoir has an inlet which is sealed once ink has been added while an inking roller fits in an outlet on the same side as the inlet. Thus ink can only flow onto the roller when the reservoir and whole machine is inverted for use. An air inlet is provided on the other side of the reservoir from the outlet and roller and that inlet is opened when the reservoir is inverted. Only then will ink flow during rotation of the roller when a ribbon is moved over it.

9 Claims, 5 Drawing Figures

INKING MACHINES

This application is a continuation-in-part of my application Ser. No. 06/246,691 filed on Apr. 16, 1981, now abandoned.

This invention relates to a machine for inking typewriter ribbons and the like.

BACKGROUND TO THE INVENTION

When such ribbons have passed more than a few times through a typewriter, the ink deposit on the surface becomes progressively used up so that the resulting typing becomes lighter and lighter. It has then necessary to replace the ribbon despite the fact that the actual backing to the ribbon is still in good condition. Therefore, it would be desirable if the ribbon could be re-inked.

There have been proposals for re-inking typewriter ribbons but generally these machines have either been very complex and expensive so that the cost of re-inking is comparable to the cost of a new ribbon or, in the case of simple machines, they have not been convenient and clean to use.

It is therefore an object of this invention to provide a relatively simple and cheap re-inking machine which is easy and clean to use.

BRIEF SUMMARY OF THE INVENTION

According to the invention there is provided a machine for inking typewriter ribbons and the like comprising an air-tight ink reservoir having an ink inlet to be sealed tight once ink has been added, an inking roller to the cylindrical surface of which ink is delivered from the reservoir and over which a ribbon to be inked rolls to transfer ink from the cylindrical surface onto the ribbon, an outlet through which ink can pass from the reservoir into contact with part of the cylindrical surface of the inking roller, the outlet being on the same side of reservoir as the inlet so that ink cannot flow out of the outlet under gravity until the reservoir is inverted after the reservoir has been filled and the inlet sealed, air inlet means to the reservoir capable of being opened when the reservoir has been inverted and a ribbon is to be inked to allow the ink to flow out from the reservoir through the outlet in contact with the cylindrical surface, and means for moving a ribbon to be inked over the inking roller to deposit ink from the surface onto the ribbon.

With such a machine, the ink is not exposed to the atmosphere and no open reservoir is provided. This very much increases the cleanliness of use of the machine since ink will not be dispensed until the machine is inverted after inserting a ribbon to be re-inked. Further, since the reservoir is closed, there is less chance of the ink drying out with time since the machine will tend to be used intermittently in an office.

The ink can be a very viscous mixture of carbon black and oil and, by virtue of its highly viscous state, the very finely divided carbon black or soot will not separate out easily with time. Additionally the air-tight sealing of the reservoir will tend to retain the ink in the reservoir even if the reservoir is inverted so that the risk of leakage from the reservoir is very low indeed. Once however the air inlet means have been opened, the ink will flow slowly through the outlet as the ink roller is rotated by the ribbon and ink will be transferred to the ribbon being inked.

According to one embodiment of the invention, the reservoir is removable and replaceable together with the outlet and inking roller so that the user can have a number of reservoirs each containing ink of a desired colour so that he can readily swap the reservoir and a colour applied to a ribbon as required. In the event that the user wishes to re-ink a two-colour ribbon which is for example red over one half of the width of the ribbon and black over the other half, the outlet can have a width of approximately half the width of the inking roller and be positioned to supply ink solely onto slightly less than one half of the roller starting from one edge thereof. In this way such a machine has the advantage that during the re-inking of one half width of the ribbon, the whole width of the ribbon is supported by the full width of the inking roller also ink is only applied to about half of the roller whereas the inking roller itself had only been of approximately half the width of the ribbon then the ribbon could become distorted during its re-inking. This is not possible where the roller is positioned in an open-topped ink reservoir.

According to one embodiment of the invention the ink outlet has an arcuate shape and the inking roller is positioned in that arcuate shaped outlet so substantially closing it. When the reservoir is inverted, ink will contact that part of the roller's surface within the outlet and upon rotation of the roller this inked surface will become exposed. On the side of the outlet where the freshly inked surface becomes exposed the outlet preferably defines a slit to allow a thin film of ink adhering to the surface to leave the outlet. According to one preferred embodiment of the invention a blade is provided having an edge movable transversely of the longitudinal axis of that slit to adjust the width of the slit and accordingly the thickness and so amount of ink adhering to the surface of the roller. The blade can be pivotally mounted as a crank at one end opposite the said edge about a pivot rod and a screw provided to engage a further crank arm on the pivot rod so that rotation of the screw causes rotation of the pivot rod and so movement of the blade to adjust the width of the slit.

According to an alternative embodiment, adjustment of the rate which ink is supplied to the roller is achieved by moving the roller transversely of its rotational axis towards and away from the outlet to vary the size of the opening between the surface of the inking roller and the outlet.

To ensure that the reservoir opens automatically once the machine has been ready to re-ink a ribbon and a ribbon inserted for re-inking, abutment means can be provided which are resiliently movable by contact with a supporting surface for the machine when the latter is stood on that surface so that the reservoir inverted, the abutment means being connected to the air inlet means and the movement of abutment means on contact with the surface opening the air inlet means. Thus, the machine will normally be stood with the reservoir so that the outlet and sealed inlet are at the top of the reservoir. In this position the ribbon is loaded onto the means for moving the ribbon past the roller. Then the whole machine is inverted which causes the abutment means to open the air inlet and the ribbon is drawn past the inking roller. Then once the re-inking operation is complete the whole machine is inverted back to its normal position where the outlet is uppermost and the re-ink ribbon unloaded.

Although for simplicity reference is made herein to the re-inking of typewriter ribbons, the machine of the invention is useful for re-inking all types of ribbons of all types of printing machines including those for telex machines, calculators and the like.

BRIEF DESCRIPTION OF THE DRAWINGS

A typewriter ribbon re-inking machine according to the invention will now be described, by way of example, with reference to the accompanying drawings, in which.

DESCRIPTION OF THE PREFERRED EMBODIMENTS

Figure 1:
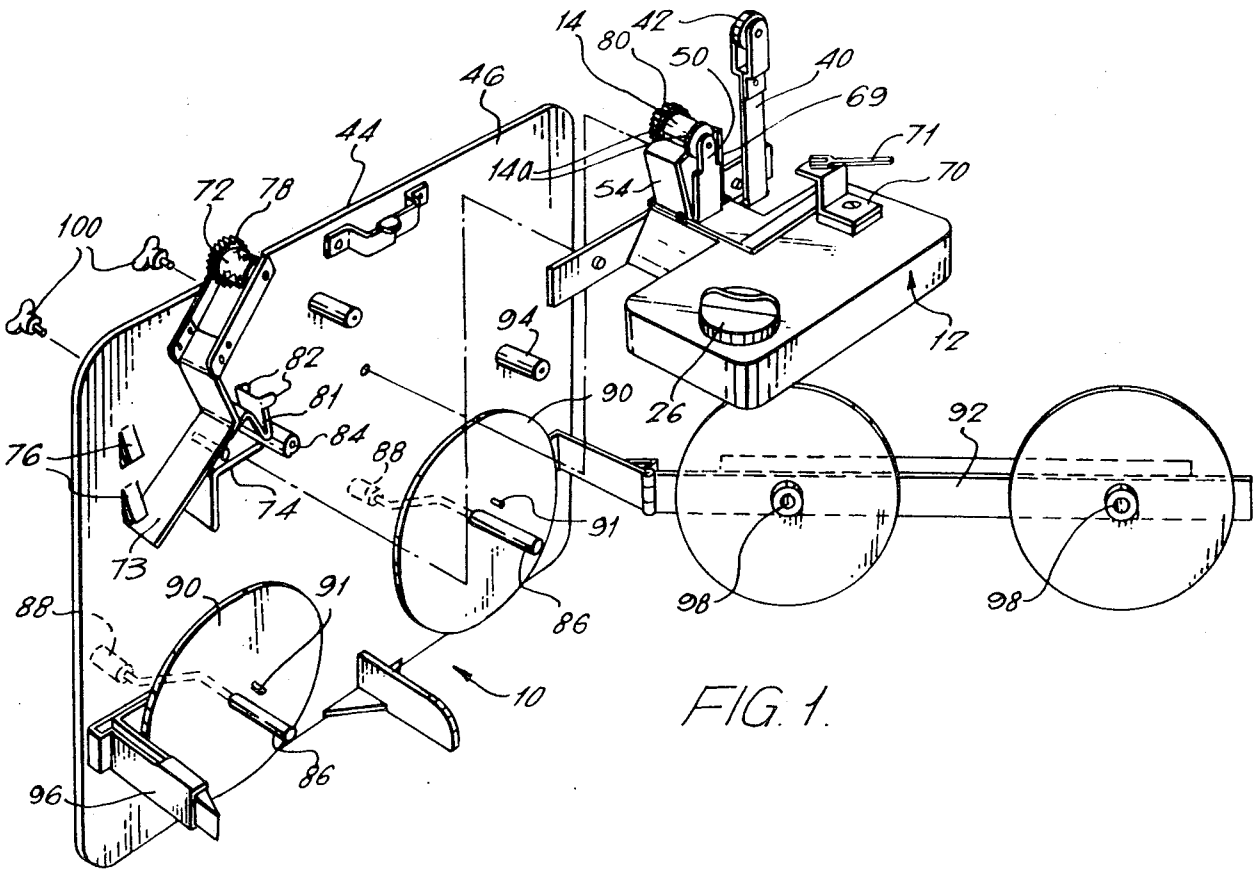
FIG. 1 is a perspective view of the machine shown dissembled.

The inking machine 10 shown in the drawings comprises a removable ink reservoir 12 which carries an inking roller 14. In turn ink is transferred from that roller to a ribbon 16 to be re-inked which is held between two spools 18 and 20.

Figure 5:
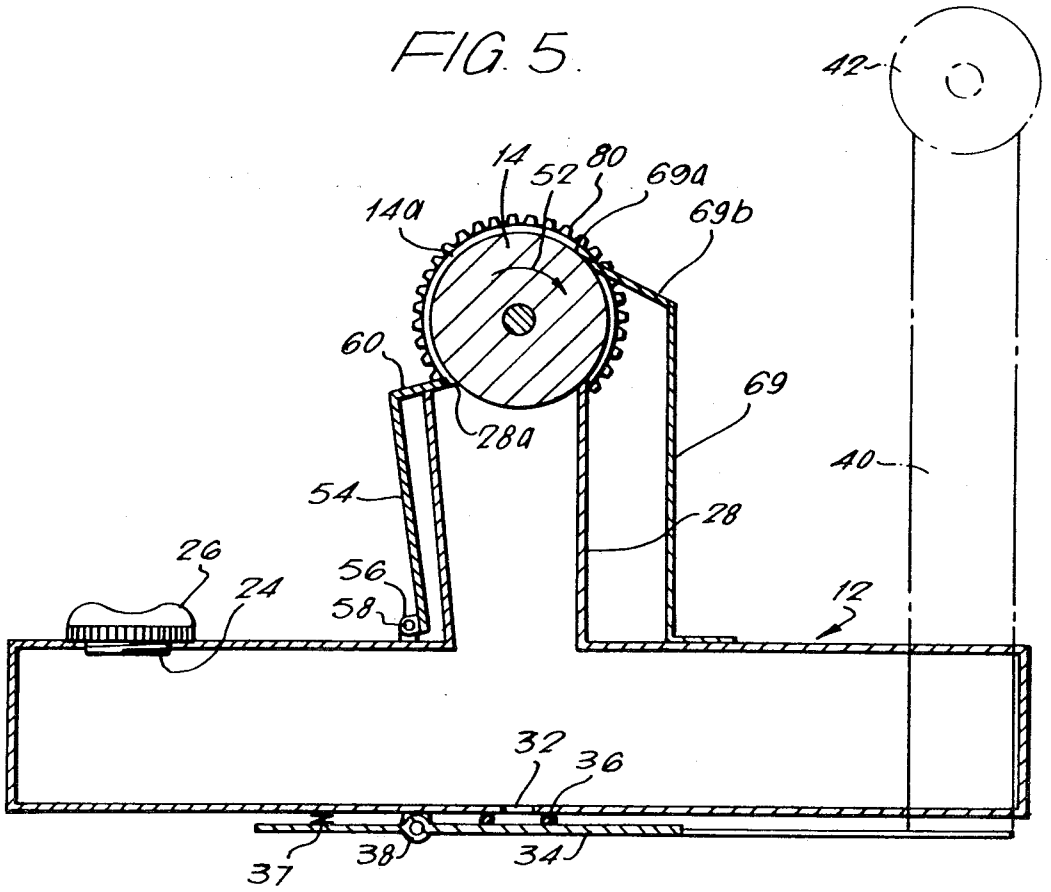
FIG. 5 is an enlarged diagram through the ink reservoir and inking roller.

As best shown in FIG. 5, the reservoir 12 has an inlet 24 closed by means of a screw cap 26. When the screw cap is tightly closed, the inlet 24 is sealed in an air-tight fashion.

An ink outlet 28 is provided from the reservoir on the same side as the ink inlet. This outlet is in the form of an upstanding rectangular-shaped tube open at the top. The open top is of an arcuate shape. In that arcuate-shaped opening is positioned the inking roller 14. The roller largely closes the outlet and is 1 to 2 mm longer in the axial direction than the outlet. Because the outlet 28 is on the same side of the reservoir as the inlet 24, ink will not normally pass up through the outlet when the reservoir is oriented as shown in FIG. 5. It is only when the reservoir and indeed the whole inking machine 10 is inverted (as in FIG. 2), that ink will pass to the inking roller.

Figure 2:
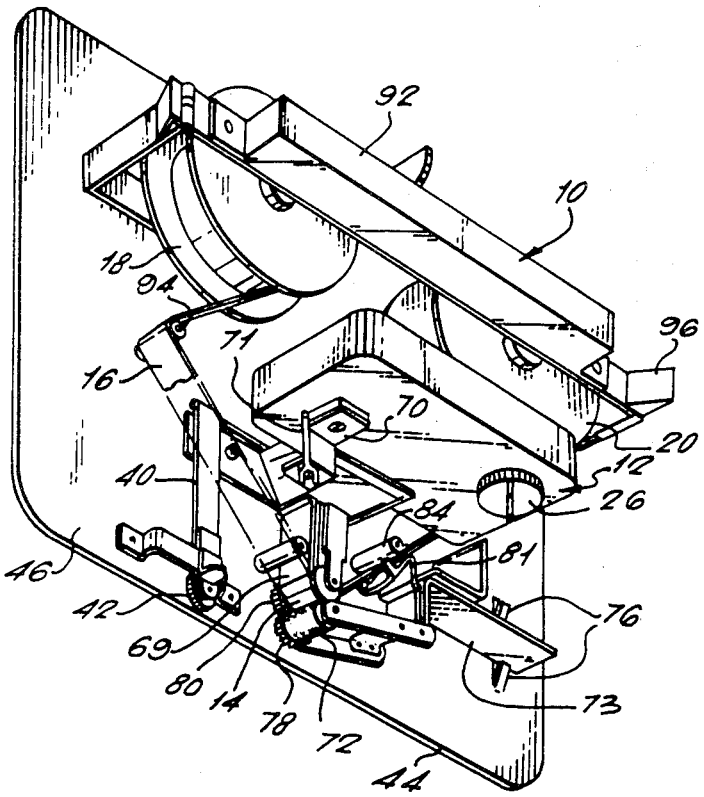
FIG. 2 is a perspective view showing the machine in use.
Figure 3:
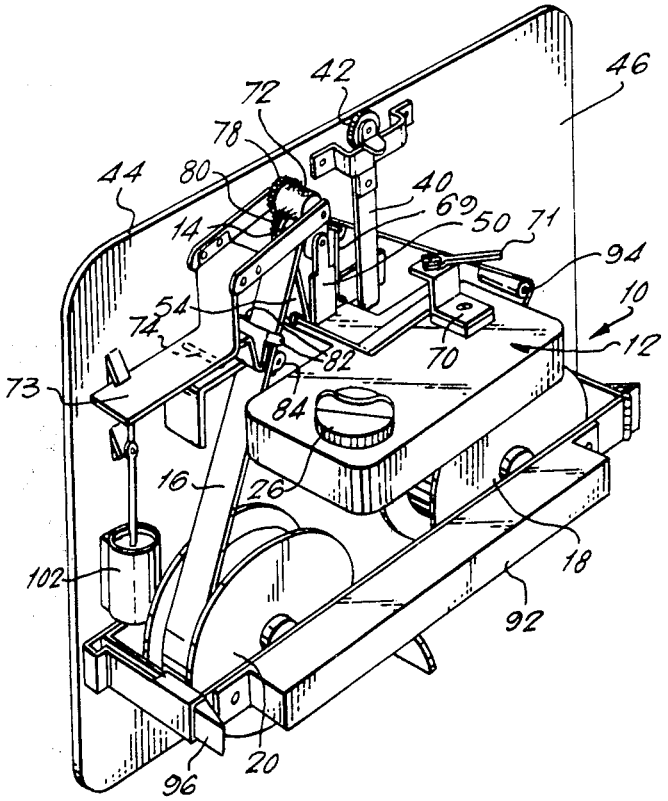
FIG. 3 is a view similar to FIG. 1 showing the machine with a ribbon to be inked fitted in place.

On the opposite side of the reservoir, i.e. the underside in the orientation shown in FIG. 5, is provided an air inlet 32. This is normally closed by a hinged cover 34 which bears against a circular seal 36 around the periphery of the air inlet 32. The hinged cover is biased by a spring 37 to the closed position and is hinged about a pair of hinges 38 one of which is shown in FIG. 5. Attached to the outer end of the hinged cover 34 is a push rod 40 and the upper end of which rotatably supports a small wheel 42, ball or the like. As best shown in FIG. 3, that wheel 42 extends slightly above the top edge 44 of a support plate 46 for the machine. Thus, when the whole machine is inverted and placed so that it stands on the edge 44 during a re-inking operation as shown in FIG. 2, the wheel 42 contacts the surface, on which the machine 10 is supported and is resiliently displaced so causing the hinged cover 34 to be displaced and allow the air inlet 32 to open. At the end of an inking operation when the machine is restored to its non-working orientation as shown in FIG. 1, the spring 37 urges the cover 34 to reclose the air inlet 32.

Figure 4:
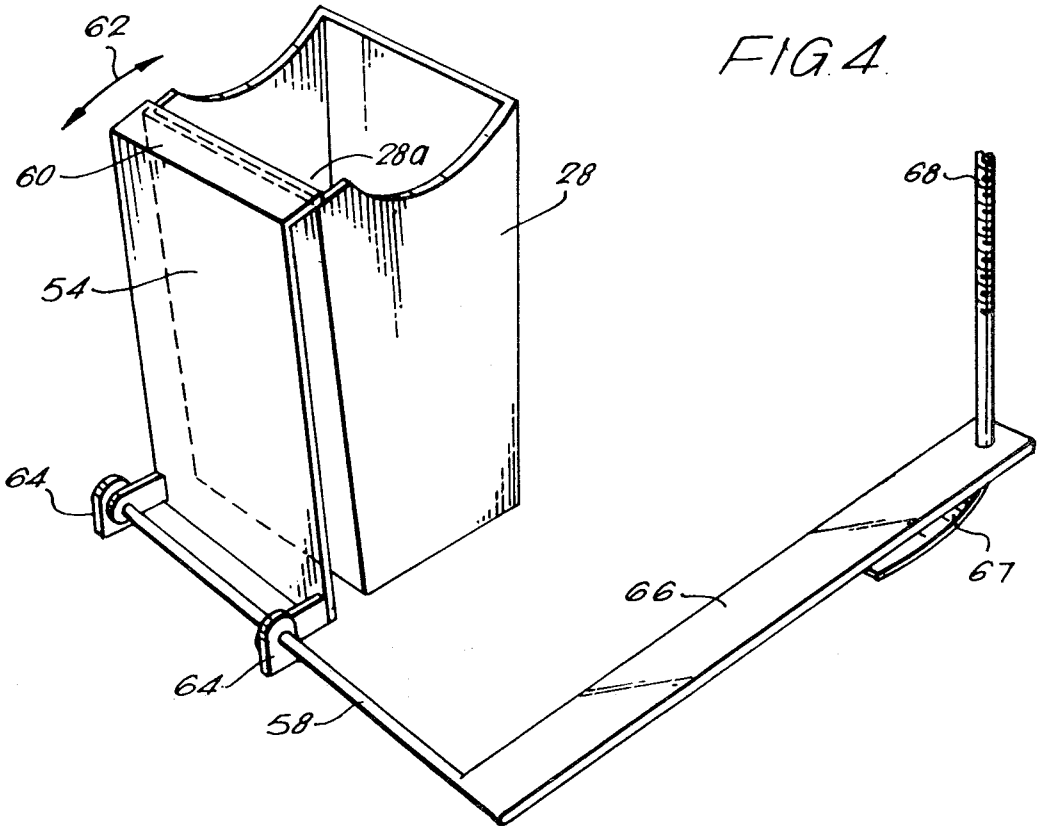
FIG. 4 is an enlarged diagram showing the ink outlet.

The inking roller 14 is rotatably supported by a pair of lugs 50 upstanding from the outlet 28 and at its edge it has a pair of circular guide flanges **14*a* to guide the ribbon 16. During a re-inking step, the roller 14 will rotate with its inked surface in contact with a ribbon 16 in the direction of rotation shown by the arrow 52 in FIG. 5. As best seen from FIGS. 4 and 5, the left-hand side of the outlet 28 is displaced slightly from the surface of the roller to define an outlet slit 28*a* whereas the right-hand side of the outlet 28 is in close contact with the surface of the roller. Therefore, as the roller rotates with the reservoir in an inverted condition, ink will come into contact with that portion of the cylindrical surface of the roller 14 within the arcuate-shaped outlet and a film of ink will adhere to the surface and be entrained with the surface through the slit 28*a***.

In order to adjust the amount of ink which is so entrained on the surface and therefore the amount of ink applied to the ribbon, a hinged plate 54 is provided. The latter has a pair of lugs 56 projecting from its lower end which are attached to a pivot rod 58 whilst at its upper end is provided a turned-in wiping edge 60. Hinging of the plate 54 allows that wiping edge 60 to be moved towards or away from the surface of the roller as shown by the arrows 62 in FIG. 4. Therefore this wiping blade 60 can control the thickness of ink which is left adhering on the surface of the roller 14.

The pivot rod 58 is supported in a pair of lugs 64 attached to the reservoir 12 and attached to it is a crank 66 whose arm is contacted by the end of a screwthreaded rod 68. The latter is screwed into a trunnion 70 attached to the top of the reservoir and can be screwed relative the latter by means of a handle 71. Thus rotation of the handle will screw the rod 68 up or down relative the arm of the crank 66 and the end of the screw rod 68 which bears on the arm 66 will cause the latter to pivot the rod 58 and in turn the blade 54 so adjusting the thickness of ink left adhering to the surface of the inking roller. The arm of the crank 66 is biased by a leaf spring 67 into contact with the end of the rod 68.

A wiper blade 69 is attached to the reservoir 12 and is made of resilient spring metal. Its free edge **69*a* bears against the cylindrical surface of the roller 14 and scrapes from the surface dust and fibre to prevent such matter entering the reservoir. It also has a portion 69*b*** which the freshly inked surface of the ribbon contacts and which has the effect of smoothing the freshly applied layer of ink.

Mounted at the end of a hinged lever 73 is a rough-surfaced roller 72. The lever 73 is hinged about a pivot pin 74 to the support plate 46 and has an operative position (shown in FIGS. 2 and 3) where the roller 72 bears against the inking roller 14 to form a nip through which the ribbon to be inked passed and an inoperative position (shown in FIG. 1) where the roller is moved upwardly away from the roller 14 to allow loading and unloading of the ribbon. The lever 70 is held in these positions by means of spring clips 76.

At the side of the roller 72 is a gear 78 which meshes with a gear 80 at the side of the inking roller. In this way, the contact between the rear surface of a ribbon and the rough-surface of the roller 78 entrains the latter into rotation and in turn the meshing of the gears 78 and 80 ensures that the inking roller rotates and so can deposit its ink on the surface of the ribbon to be inked without the ribbon simply sliding past the inking roller. The rollers 14 and 78 are of the same diameter and the gears 78 and 80 have the same number of teeth so that rollers rotate at identical rate.

The lever 70 also carries a plate 81 having a pair of guide lugs 82. These are designed to engage either side of a ribbon and ensure that the ribbon is kept centred on the inking roller. In the operative position of the lever 70, the plate 81 also defines a narrow gap with a stationary guide 84 mounted on the support plate 46 so as to prevent any button or the like at the end of a ribbon from passing through the nip between the rollers 14 and 72 which could damage the smooth surface of the inking roller 14.

A ribbon 16 to be inked is held between the two spools 18 and 20. The latter are supported on shafts 86 rotatably carried by the support plate 46. The shafts 86 are integrally formed with handles 88 for winding the ribbon from one spool to the other and circular backing flanges 90 are also attached to the shafts 86. These flanges have small projecting pins 91 which engage corresponding holes (not shown) in the spools.

Instead of handles 88, the device 10 can be driven by an electric motor in which case the edges of the flanges have gear teeth which mesh with a small pinion on the output shaft of a motor (not shown).

A stabilizing member 92 is hinged to the support plate 46. This member can be swung to an open position as shown in FIG. 1 to allow the spools 18 and 20 to be inserted onto the shafts 86. Then once a ribbon has been so loaded, the member 92 is hinged to its closed position as shown in FIG. 2 where its end is engaged with a resilient locking latch 96 and the outer ends of the shafts 86 are received in supporting recesses 98.

A reversing guide 94 is attached to the support plate 46 to ensure that the freshly inked surface is reversed around it so that the freshly inked surface becomes the radially outer surface of the ribbon as it is wound onto the spool 18. It also helps to ensure evenness of the layer of freshly applied ink.

For convenience the reservoir 14 and its attached inking roller are removably attached to the supporting plate 46 by means of two butterfly screws 100. In this way a number of different reservoirs and inking rollers can be provided containing different coloured inks for use as required.

In an alternative embodiment of the invention, it is possible for the outlet 28 to cover slightly less than half the width of the roller, e.g. 0.5 to 1.5 mm narrower, so depositing ink on only about a half of the width of the roller. Such an embodiment is useful when a two-colour ribbon is to be re-inked and so only half the width of the ribbon is inked in any one operation. An advantage of this embodiment is however that the whole width of the ribbon is still supported during its passage over the ribbon despite the fact that ink is only applied to half of the width of the roller.

When the machine is to be used, ink is first of all inserted into the reservoir if necessary through the opening 24 which is then closed by screw cap 26. At this stage the inlet 32 is closed and the reservoir is in the orientation shown in FIGS. 1 and 5 and so there need be no leakage of ink.

The reservoir is then attached to the supporting plate 46, if it is not already so attached, and a ribbon to be re-inked is placed around the spools 18 and 20 and the spools are fitted on the shafts 86. The ribbon is passed between the plate 81 and guide 84 and between the lugs 82. At this stage the lever 70 is in its open position to allow the ribbon to be inserted between the rollers 14 and 72. Finally the ribbon is passed round the reversing guide 94 for passing back to the spool 18. The lever 70 is now moved to bring the roller 72 against the roller 14 so that the gears 78 and 80 mesh.

The whole machine 10 is now inverted to the position shown in FIG. 2 and stood on its surface 44. As a result the wheel 42 displaces the push rod 40 and causes the air inlet 32 to open. The inversion of the reservoir 12 allows the ink to contact part of the surface of the roller 14 but until the air seal on the reservoir is broken by the opening of the inlet 32 and because of the very viscous nature of the ink, it does not tend to run out through the slit **28*a***.

When the handle 88 associated with the spool 18 is rotated, the ribbon is wound from the spool 20 onto the spool 18 passing through the nip between the rollers 14 and 72. As the roller 14 rotates an ink film is entrained through the slit **28*a*** and that film becomes deposited on the surface of the ribbon so re-inking it.

At the completion of a re-inking step, the machine is again restored to its upright condition as shown in FIG. 1 with the result that the air inlet 32 is automatically closed and ink cannot leak from the reservoir. The lever 70 is moved to its open position and the support 92 opened to allow the two spools with the associated re-inked ribbon to be removed.

To prevent damage to the surface of the inking roller 14 when the lever 73 is removed to its operative position, a dash-pot 102 (shown in FIG. 3) can be provided.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A machine for inking typewriter ribbons and the like comprising:

a support;

an air-tight ink reservoir carried by said support;

an ink inlet to said reservoir capable of being sealed tight once ink has been added;

an inking roller carried by said support and having a cylindrical surface to which ink is delivered from said reservoir;

means for moving a ribbon to be inked over said inking roller to transfer ink from said cylindrical surface onto said ribbon;

an outlet from said reservoir immediately adjacent said cylindrical surface through which ink passes into contact with part of said cylindrical surface, the outlet being on the same side of said reservoir as the inlet so that ink cannot flow out of the outlet under gravity until said support has been inverted to invert said reservoir after it has been filled and said inlet sealed;

air inlet means to said reservoir; and means carried by said support and actuated by contact with a supporting surface on which said support stands for opening said air inlet when said support and said reservoir have been inverted and stood on said supporting surface whereby a ribbon can then be inked by a flow of ink out from the reservoir through the outlet into contact with said cylindrical surface.

2. A machine according to claim 1 in which said ink outlet has an arcuate shape in which the inking roller is positioned substantially closing said outlet, whereby when the support and reservoir are inverted, ink will contact that part of the roller's surface within that outlet, and further comprising a slit as defined between said cylindrical surface and said outlet through which ink coating said surface can pass as said roller is rotated.

3. A machine according to claim 2 further comprising a blade having an edge movable transversely of the longitudinal axis of the slit to adjust the width of the slit and accordingly the amount of ink supplied to the roller.

4. A machine according to claim 3 further comprising means for pivotally mounting said blade as a crank at an end opposite the said edge, a pivot rod about which said blade is mounted, a screw, and a further crank arm on said pivot rod, whereby rotation of said screw causes rotation of the pivot rod and hence pivoting of said blade.

5. A machine according to claim 2 in which means are provided for moving said roller transversely of its rotational axis towards and away from said outlet to vary the size of the slit and therefore the rate of flow of ink from said reservoir during re-inking of a ribbon.

6. A machine according to claim 1 further comprising abutment means resiliently movable by contact with said supporting surface for said machine when said support stands on said supporting surface with said reservoir inverted, the abutment means being connected to said air inlet means and the movement of abutment means on contact with the surface opening said air inlet means.

7. A machine according to claim 1 further comprising a roughened roller entrained into rotation by contact with the ribbon to be inked as the ribbon is moved over the cylindrical surface of said inking roller, and drive means between said roughened roller and said inking roller to rotate the inking roller as a ribbon to be inked is moved over it.

8. A machine according to claim 1 in which said ink outlet has a width of approximately half the width of the inking roller and is positioned to supply ink onto one side of the ribbon starting from one edge thereof whereby two colour ribbons can be inked one colour at a time.

9. A machine according to claim 1 in which said ribbon is mounted between two spools and support means carried by said support are provided for each spool, the means for moving the ribbon comprising means for turning one spool to wind the ribbon from the other spool over the inking roller, over a reversing guide and onto the said one spool with the freshly inked surface of the ribbon radially outside the other surface.

* * * * *